8/30/77 XR 4,044,881

United States Patent [19]

Chai et al.

[11] 4,044,881

[45] Aug. 30, 1977

[54] SERIAL PRINTER WITH LINEAR MOTOR DRIVE

[75] Inventors: Hi Dong Chai, Binghamton; Joseph Paul Pawletko, Endwell, both of N.Y.

[73] Assignee: International Business Machines Corporation, Armonk, N.Y.

[21] Appl. No.: 676,584

[22] Filed: Apr. 13, 1976

[51] Int. Cl.[2] ..... B41J 19/30

[52] U.S. Cl. ..... 197/82; 197/66; 310/14; 318/135

[58] Field of Search ..... 101/93.15, 93.16, 93.17; 197/1 R, 12, 58, 60, 66, 82; 310/12–15, 17; 318/119, 135; 178/27, 33 R

[56] References Cited

U.S. PATENT DOCUMENTS

| | | | |
|---|---|---|---|
| 3,618,514 | 11/1971 | Nyman et al. | 101/93.16 |
| 3,688,035 | 8/1972 | Cless | 310/13 X |
| 3,867,675 | 2/1975 | Kitz et al. | 310/14 X |
| 3,867,676 | 2/1975 | Chai et al. | 310/14 X |

*Primary Examiner*—Edward M. Coven
*Assistant Examiner*—Paul T. Sewell
*Attorney, Agent, or Firm*—John S. Gasper

[57] ABSTRACT

A serial line printer uses a linear stepper motor of the variable reluctance type in which the toothed stator bar acts as a guide and support for the print mechanism carrier. Sensor elements movable with the carrier sense the presence of the teeth of the stator bar and generate timing signals usable for controlling operation of the printer and the motion of the carrier. The pitch of the teeth in the stator bar is proportional to the spacing of the print locations in a line of print.

10 Claims, 10 Drawing Figures

SERIAL PRINTER WITH LINEAR MOTOR DRIVE

BACKGROUND OF THE INVENTION

1. Field of the Invention

This invention relates to printers and particularly to serial line printers.

2. Description of Prior Art

Serial line printers are well known in which a print mechanism is moved along a fixed line relative to a stationary print medium. The print mechanism can take various forms such as a type wheel, disk, sphere or cylinder (which print whole characters or other data symbols at various positions of a print line on a print medium), or one or more wires, electrodes, ink jets or other markers (which print characters, etc. using dots or other marks in groups or patterns). Printing may occur on-the-fly or when the print mechanism is at rest relative to the print medium and may be performed when the print mechanism traverse occurs in one or both directions. Regardless of the type of print mechanism used or the manner of printing, it is imperative that the lateral relative movement of the print mechanism be very precisely controlled in order to assure making the print impression at precise locations, if high quality printing with desired legibility is obtained.

It has been a long time practice to mount the print mechanism on a carrier which is movable on a horizontal bar or guide and to drive the carrier and print mechanism with a stepwise or continuous motion along the bar. A well-known drive mechanism comprised an electric motor connected by gearing, drive belts, feedscrews or the like to the print mechanism or carrier. See for example, U.S. Pat. Nos. 3,882,988, issued to Charles T. Sloan et al. on May 13, 1975, and 3,985,463, issued to James J. Boyce et al. on Sept. 16, 1975. The drive motor is controlled by circuits activated to control its direction and motion to cause the desired location movement of the print mechanism It is well known that such mechanisms are relatively complex and costly and contain certain inherent defects such as backlash or play. Such defects can cause positioning errors which affect the quality of printing. The magnitude of the error increases with use due to wearing and requires increasing service and adjustment to maintain desired accuracy.

It has been proposed in the prior art to eliminate the backlash and wear problems associated with the gear, belt, and feedscrew drive mechanisms by using a linear type electric motor which essentially comprises a bar of high-permeability magnetic material which passes through a solenoid attached directly to the print mechanism carrier. Examples of such arrangements are shown in U.S. Pat. Nos. 3,618,514 issued to A. Nyman et al. on Nov. 9, 1971; 3,688,035 issued to G. Cless on Aug. 29, 1972 and 3,867,675 issued to N. Kitz et al on Feb. 18, 1975. In these patents, the linear motors are of the Lorenz force type having no natural detenting properties and the force properties are relatively low. Thus, print mechanisms transported by these motors must be relatively light weight and print mechanism positioning or motion with precision is not easily achieved.

It is a further practice in serial line printers to use a signal generator as part of the controls for timing the operation of the printer and/or motion of the print mechanism. Common signal generators comprise a grid extending along the print line or an encoder wheel attached to the drive motor. It always requires great care to locate the grid and encoder wheels relative to the print positions in the print line.

SUMMARY OF THE INVENTION

It is therefore the general object of this invention to provide an improved printer apparatus.

It is a more particular object of this invention to provide a printer apparatus having an improved drive arrangement.

It is a further object of this invention to provide a serial line printer capable of being operated with increased precision in the motion and positioning of the print mechanism.

It is an additional object of this invention to provide a serial line printer in which the drive mechanism for the print mechanism is relatively simple, is easily adjusted and requires less maintenance and service.

It is a still further object of this invention to provide an improved arrangement for providing control pulses for operating a serial line printer.

The above, as well as other objects, are achieved in accordance with this invention by providing a serial printer apparatus in which the drive for the print mechanism is a linear stepper motor, preferably of the variable reluctance type. In accordance with this invention, the stator bar is fixed relative to the print line and the carrier of the print mechanism which also supports the armature portion of the motor rides on the stator bar. The stator bar includes a magnetic structure having uniformly spaced teeth extending in the direction of motion of the carrier. The teeth of the stator bar have a pitch proportional to the spacing of the print positions. Since the linear stepper motor has a natural detent capability, the positioning of the carrier and control over motion is very precisely maintained relative to the print positions since the spacing of the teeth can be very accurately made and the bar is easily mounted in position for guiding the carrier. A further feature of this invention for obtaining accurate control over movement of the print mechanism involves the use of the stator bar teeth as the means for generating the control signals. For that reason, sense means are provided which move with the carrier. The sense means are designed and arranged to detect the distinction between the tooth surface or tooth gap and generate signals indicative of a position or amount of movement of the carrier. Generating control signals by sensing the stator teeth eliminates the need for a grid or encoder element and consequent alignment problems. Since the teeth of the stator bar are spaced in proportion to the spacing of the print positions on the line of print, very precise printing can be achieved with a minimum of structure and maintenance.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

Figure 1:
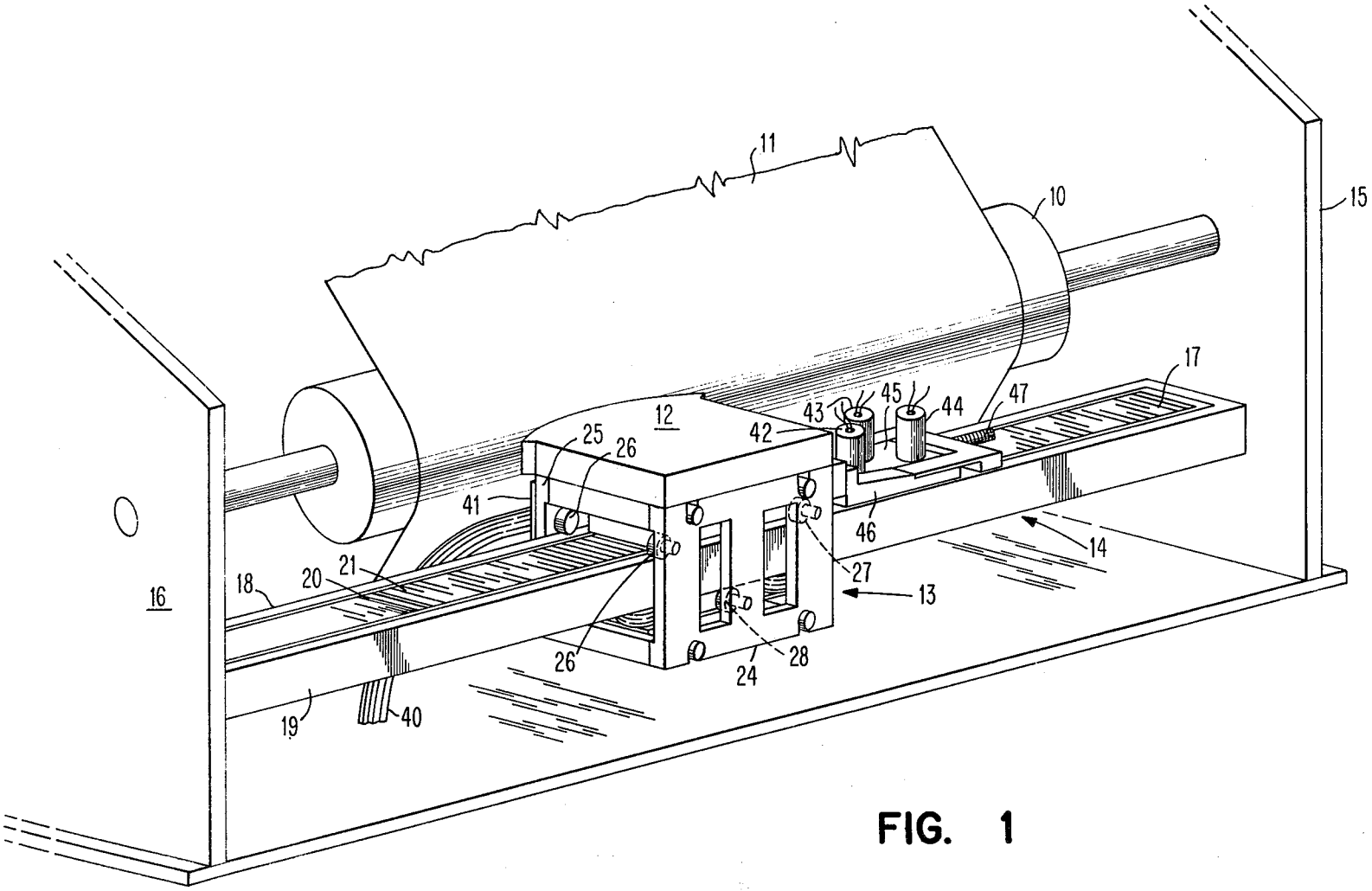
FIG. 1 is a perspective view of a serial printer apparatus showing a general arrangement using this invention.
Figure 2:
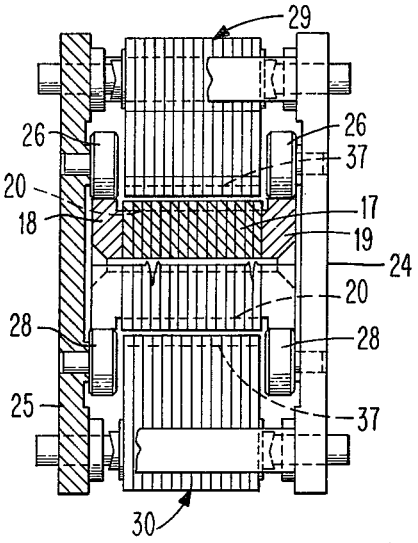
FIG. 2 is a vertical section of the carrier and motor portions of the printer of FIG. 1.
Figure 3:
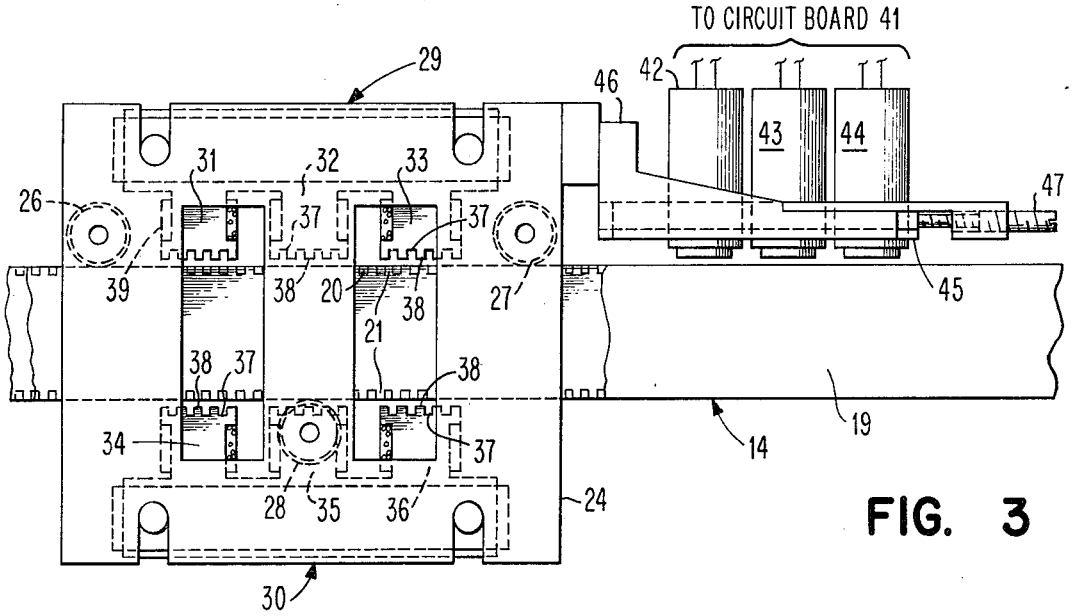
FIG. 3 is a side elevation of the carrier and motor portion of FIG. 2.

Referring to FIGS. 1-3, a serial line printer apparatus consisting of a carriage or platen 10 on which is mounted a print medium such as paper 11. A print mechanism 12 is mounted on a movable carrier 13 to be moved across paper 11 to print characters, patterns or other data marks which represent data to be recorded. As previously mentioned, the print mechanism 12 may take any form, such as rotatable disk with a print hammer which strikes type elements against paper or it may be in the form of a print head such as an ink jet or wire printer designed to record characters or other data symbols as a matrix of dots. The specific nature of the printer mechanism does not form part of the invention and will not be described further.

In accordance with this invention, a stator bar 14 is attached at opposite ends to vertical plates 15, 16 or the like to provide a guide and support structure to the carrier 13. Stator bar 14 comprises a stack of magnetic lamination 17 rigidly held between outer rail pieces 18 and 19. The upper and lower surfaces of the laminations 17 are formed with uniformly spaced parallel grooves 20 transverse to the longitudinal axis of stator bar 14. Teeth 21 formed between grooves 20 preferably have a uniform width and tooth pitch in the manner of a variable reluctance magnetic structure. Grooves 20 and the spaces between rail pieces 18 and 19 are preferably occupied by a filler material 22 to prevent dust and moisture from collecting on the stator bar 14.

Carrier 13 comprises a pair of side frames 24 and 25, and has two upper sets of rollers 26 and 27 for riding on the upper edge of rail pieces 18 and 19. A third set of rollers 28 is supported by side frames 24 and 25 to engage the bottom edge of rail pieces 18 and 19.

Also supported by carrier 13 is the armature portion of the linear stepper motor which coacts with the magnetic laminations 17 of the stator bar 14. The armature can take various forms, but preferably comprises magnetic E-cores 29 and 30 that move along both sides of stator bar 14. The E-core legs 31-36 terminate in pole faces having parallel grooves 37 which form teeth 38. Windings 39 are applied to the E-core legs. Energization currents are applied to the windings via a flexible flat cable 40 connected to a terminal board 41 attached to side frame 25. The E-cores 29 and 30 are preferably laminated in the manner of the magnetic portion stator bar 14. The width of the teeth 38 in E-core pole faces and the pitch thereof is preferably the same as the width and pitch of teeth 21 in stator bar 14. The E-core legs 31-36, however, have a spacing so that only one set of teeth 21 of stator bar aligns with teeth 38 of the E-core legs when current is applied to winding 39 to effect motion of the stepper motor along stator bar 14. Various arrangements for energizing the windings 39 to effect linear motor operation can be used to practice this invention; however, in the preferred mode, the windings 39 are bifilar and the E-cores are structured to have an odd number of pole pairs and the sequence of energizing the windings of the coils is performed in the manner shown and discussed in detail in U.S. Pat. No. 3,867,676, issued to H. D. Chai and J. P. Pawletko on Feb. 18, 1975. Further information relative to details of the magnetic structures and the method of operation may be understood by reference thereto.

In the above description, a linear stepper motor is described which is essentially a variable reluctance type. In that type of motor, detenting is obtained by maintaining certain windings 39 energized when the carrier 13 is not in motion. The invention may be practiced using a linear stepper motor which uses permanent magnets as part of the E-core structures. In that event, the windings 39 will not be energized to effect detenting of the carrier in a predesired position.

According to one aspect of this invention, the spacing, i.e. the pitch, of the teeth 21 of stator bar 14 is proportional to the spacing of the printing on paper 11. For example, if it is desired to print characters at ten per inch, then the pitch of teeth 21 would be 0.100 inches or 100 mils. The pitch of teeth 38 on the pole faces of E-cores 29 and 30 would likewise be 100 mils; however, the longitudinal spacing of the E-core legs would be offset by a fraction of a tooth pitch. In a preferred embodiment, the teeth in the legs 31, 32 and 33 of E-core 29 are offset with respect to each other by one-third tooth pitch. The same offset exists for E-core 30. Thus, the carrier 13 can be made to move or to be stopped by appropriate sequence of energizing of windings 39 in three increments of a character space in the print line. Consequently, very precise location of the characters can be made in the print line and proportional spacing is readily obtainable. The number of increments of motion that the carrier 13 can be moved within the print positions can be further increased using the two phase energization scheme described in the previously mentioned U.S. patent of H. D. Chai and J. P. Pawletko. By alternating between one- and two-phase energizing scheme, the number of steps can be increased from three to six. Thus, the carrier is moved or stopped very precisely at any of six equally spaced positions of a print position so that a character or data symbol can be easily positioned on paper 11 with greater accuracy. This higher number of increments of motion become even more significant where characters are printed in accordance with a matrix pattern and there are plural vertical stroke positions in the character matrix and positioning or printing during motion must be precise to avoid distortion of the character or data pattern.

In accordance with another aspect of this invention, the teeth 21 of the stator bar 14 are used as the means for generating signals for controlling the movement of the carrier 13 and for operation of the print mechanism. For that purpose, sense means is provided which detects the edges of the teeth 21 in stator bar 14 and generates timing signals in synchronism with the motion of carrier 13. In the preferred embodiment of the invention, the sense means comprises sensors 42, 43 and 44 maintained in position above stator bar 14 by a support plate 45 slidable on a bracket 46 rigidly attached to side frames 24 and 25 or carrier 13. The sensors 42-44 are attached to support plate 45 in a manner so that they extend below bracket 46 and are held in close proximity to upper surface of stator bar 14. (Since stator bar 14 has teeth on the under surface of the same size and pitch, etc., as teeth 21, sensors could be located below stator bar 14 or on both sides).

Figure 8:
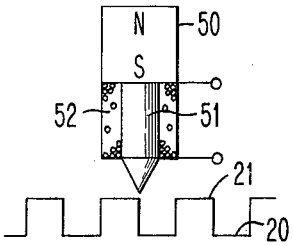
FIGS. 8 - 10 show various sensor devices useful for generating pulses from the stator bar teeth in accordance with this invention.

Sensors 42–44 can be of various types and take various forms. FIG. 8 illustrates a sensor which is a magnetic reluctance type comprising a permanent magnet 50 and a magnetic probe 51. Timing signals are produced at the terminals of winding 52, as a result of the change in reluctance caused by motion of probe 51 relative to teeth 21 and grooves 20 during movement of carrier 13.

Figure 9:
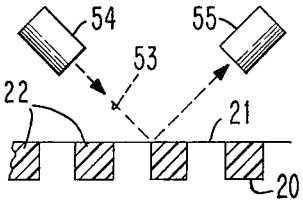

FIG. 9 illustrates a sensor which is optical. A beam of light 53 from source 54 is reflected from the surface of teeth 21 to a photocell 55 while the same level of reflectance does not occur from the surface of filling material in grooves 20.

Figure 10:
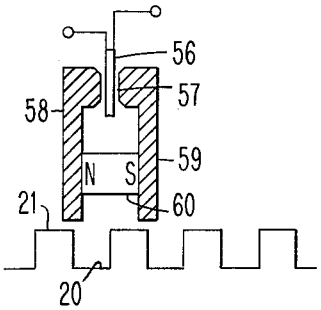

FIG. 10 illustrates a sensor in which a Hall cell 56 is located in a gap 57 in a magnetic circuit comprising permanent magnetic 60 and soft iron bars 58 and 59. The ends of the bars 58 and 59 are separated a distance equal to the pitch of teeth 20 of a multiple thereof.

Where optical sensors are used, the reflective surfaces of the teeth 21 in stator bar 14 must be kept highly polished. Magnetic sensors are preferred devices since polishing is not required and other problems associated with expansion coeffecient differentials are avoided.

Figure 4:
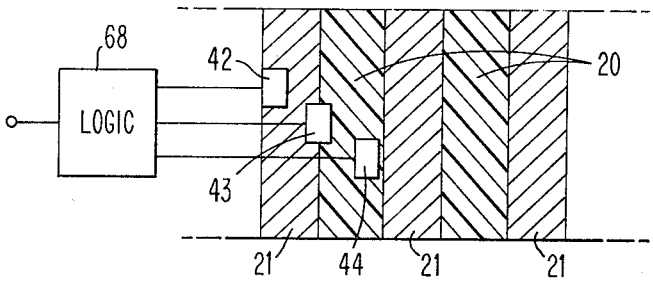
FIG. 4 is a schematic diagram showing one physical arrangement of the sensors relative to the stator bar teeth of the drive control.
Figure 5:
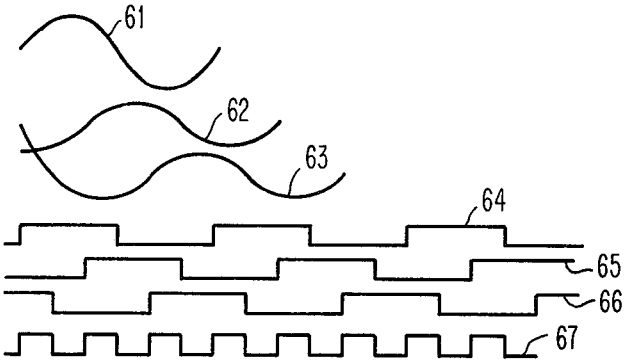
FIG. 5 is a timing chart showing representative signals generated by the sensors according to the physical arrangement shown in FIG. 4.

FIG. 4 shows an arrangement of the three sensors 42, 43 and 44 mounted one-third tooth pitch apart. In FIG. 5, curves 61, 62 and 63 are sinusoidal signals having a 120° phase displacement generated respectively by sensors 42, 43 and 44 for the one-third tooth pitch of FIG. 4. Curves 64, 65 and 66 represent synch pulses amplified and derived, respectively, from sine waves 60, 61 and 62 by logic circuit 68 in FIG. 4 with curve 67 representing the pulse train output of logic circuit 68.

The timing signals illustrated by FIG. 5 can be used in various ways for timing operation of the print mechanism 12, the motion of carrier 13 or both. One particular application is closed-loop operation of the linear stepper motor. In this application, the train of pulses 67 are used as feedback pulses to the drive circuit of the linear stepper motor.

Figure 6:
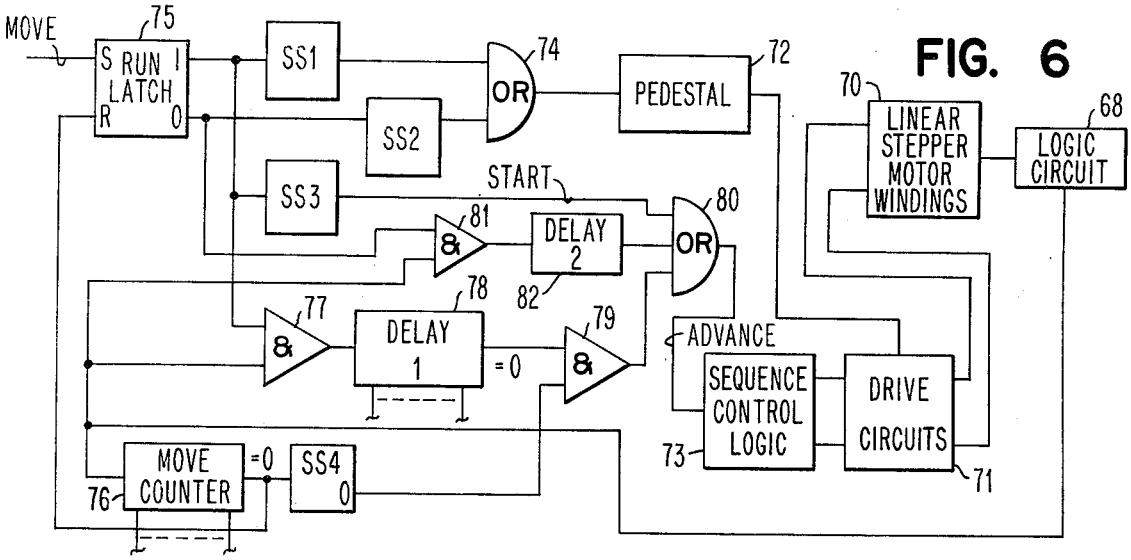
FIG. 6 is a circuit diagram showing the controls for the printer apparatus of FIG. 1.
Figure 7:
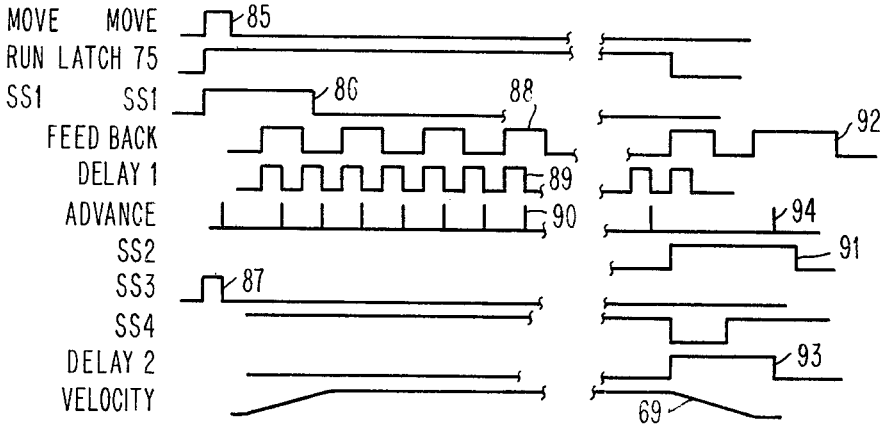
FIG. 7 is a timing chart illustrating the operation of the circuit diagram of FIG. 6.

FIGS. 6 and 7 illustrate one specific embodiment of a control arrangement in which the feedback pulses from sensors 42–44 are used to control the motion of the carrier 13 and print mechanism 12 in the printer of FIGS. 1–4, as depicted by the velocity profile curve 69 in FIG. 7. As seen in FIG. 6, the linear stepper motor windings 70 of carrier 13 are connected through drive circuits 71 to a pedestal circuit 72 and sequence control logic 73. The internal connection of windings 70, the drive circuits 71 and sequence control logic 73 could preferably be as shown in the aforementioned U.S. Pat. No. 3,867,676. The pedestal circuit 72 is connected by OR circuit 74 through single slots SS1 and SS2, which are in turn connected to the 1 and 0 outputs of RUN LATCH 75. The pedestal circuit 72 is operated to apply high voltage to the drive circuits when SS1 and SS2 are turned on and otherwise apply a lower voltage when these single shots are turned off. Feedback pulses from logic circuit 68 produced from the sensors 42 - 44 (see FIG. 4) are supplied to the input of a MOVE COUNTER 76 and through AND circuit 77 to a delay circuit 78 which is adjustable from an external source. The output of MOVE COUNTER 76 is connected through single shot SS4 to a first terminal of AND gate 79. The output of DELAY 1 circuit 78 is connected to the second input of AND circuit 79. MOVE COUNTER 76 is set to the desired count level by an external input such as a data processor (not shown). MOVE COUNTER 76 operates to turn off the 0 side of SS4 when it is decremented to zero count condition by feedback pulses from logic circuit 68. The turning off of the 0 side of single shot SS4 blanks pulses from DELAY 2 circuit 78. A zero count condition of MOVE COUNTER 76 also resets RUN LATCH 75. This turns on single shot SS2 to activate pedestal circuit 72 as previously described. Also the RUN LATCH 75, when reset, gates feedback pulses through AND circuit 81 to DELAY 2 circuit 82. ADVANCE pulses for operating the sequence control logic 73 are provided from DELAY 2 circuit 82 and DELAY 1 circuit 78 through OR Gate 80.

The operation of the control arrangement of FIG. 6 is explained in reference to FIG. 7, as follows.

Initially, carrier 13 is at rest, for example, at the left margin of paper 11 prior to the beginning of the cycle of printing. At this time, the pedestal circuit 72 applies a low voltage to drive circuits selected by the sequence control circuit 73 to detent the linear stepper motor and hold carrier 13 and print mechanism 12 at the precise desired margin location. When it is desired to initiate printing over a print line or a portion thereof, MOVE COUNTER 76 is set by an external control to a count level representing the desired length of movement of the print carrier 13. At the same time, the DELAY 1 circuit 78 is set representing the lead angle for the motor. Upon completion of these settings, a MOVE pulse sets RUN LATCH 75. This causes single shot SS1 to produce a timed pulse 86 which turns on pedestal circuit 72 for the same time interval. Single shot SS3 is also turned on by RUN LATCH 75 to generate a START pulse 87 applied to OR gate 80 to set the initial position for sequence control logic 73. With pedestal drive circuit 72 applying high voltage to the drive circuits 71, the windings 70 are energized, the stepper motor accelerates, as shown in curve 69 causing sensors 42–44 (see FIG. 4) to cause feedback pulses to be generated through logic circuit 68. When the linear stepper motor accelerates carrier 13 to the desired speed, the single shot SS1 has timed out and pedestal circuit 72 returns to the low voltage output. The feedback pulses applied through AND gate 77 to DELAY 1 circuit 78 produce delay pulses 89 which are gated through AND circuit 79 to OR gate circuit 80. Advance pulses 90 are produced by the negative transition of the DELAY 1 pulses 89 and applied to sequence control logic 73 to energize the winding of the linear stepper motor to produce continuous motion of the carrier 13 at a constant velocity rate. At the end of the predetermined count MOVE COUNTER 76 activates SS4, which blanks further pulses from DELAY 1 circuit 78 and blanks ADVANCE pulses being applied to sequence control logic 73. The RUN LATCH 75, being reset by MOVE COUNTER 76, also turns on a single shot SS2, which applies pulse 91 to switch PEDESTAL CIRCUIT 72 to the high voltage condition. This decelerates the linear stepper motor and carrier 13 as seen in curve 69. Pulse 93 from DELAY 2 circuit 82 generates a last ADVANCE pulse 94 which brings the linear stepper motor to the zero velocity condition. When pulses 91 of single shot SS2 goes to zero, PEDESTAL CIRCUIT 72 switches to low voltage and the linear stepper motor is detented to hold carrier 13 at a hold position. The hold position may occur at the end of a print line of paper 11 or at any intermediate position awaiting a repeat of the operation already described.

While the above description illustrates a control for the printing on-the-fly during the constant velocity portion of curve 69, other control arrangements can be provided for using the feedback pulses for printing on a start-stop basis. Also, while the invention has been described in connection with controlling the motion of the print mechanism along the print line, the feedback pulses from the sensors 42–44 can be used or converted to other sequences to control the operation of the print mechanism. For example, feedback pulses could be used to operate a print hammer in a rotatable disk printer whether the carrier is moving or at standstill. Likewise, the feedback pulses would be useful for operating a hammer mechanism where the paper 11 is driven against a type wheel, drum or other type carrier located behind the paper. Feedback pulses produced in accordance with this invention could also be used to control operation of print wires or other marking elements in print mechanisms which print characters in matrix form and might be used to control the operation of selection, charging or deflection devices associated with ink jet printers.

While the invention has been particularly shown and described with reference to preferred embodiments thereof, it will be understood by those skilled in the art that the foregoing and other changes in form and details may be made therein without departing from the spirit and scope of the invention.

We claim:

1. A serial printer apparatus comprising in combination:

a print mechanism operable for recording data marks or the like on a print medium, and drive means for causing said print mechanism to traverse said print medium in a fixed path corresponding with a print line on said print medium, said drive means comprising a linear stepper motor having a magnetic stator bar fixed in a position substantially parallel with said fixed path, said stator bar having at least one surface with teeth extending along the direction of said fixed path, said teeth having a pitch proportional to the spacing of print positions on said print line, a carrier for said print mechanism movably mounted on said stator bar, said carrier including an armature formed with poles having surfaces cooperative with said surface of said stator bar and windings on said poles, said pole surfaces having teeth with a pitch correlated to the pitch of said stator bar teeth, and control means connected to energize said windings for controlling the motion of said carrier and print mechanism along said stator bar said control means including sense means movable with said carrier and coating with the teeth of said stator bar for generating control signals useful in the operation of said printer apparatus.

2. A serial printer apparatus in accordance with claim 1, in which said sense means coacts with said teeth of said stator bar to generate feedback signals for controlling the velocity of said carrier.

3. A serial printer apparatus in accordance with claim 1, in which said sense means comprises plural sense elements each coacting with said stator teeth to generate plural sets of feedback signals, said plural sense elements being arranged to generate plural out-of-phase feedback signals.

4. A serial printer apparatus in accordance with claim 3 in which said sense elements are optical.

5. A serial printer apparatus in accordance with claim 4 in which said teeth of said stator bar have reflective surfaces, and said optical sense elements comprise means for projecting light onto said reflective surfaces, and photosensitive means for generating electrical signals in response to reflected light from said reflective surfaces.

6. A serial printer apparatus in accordance with claim 3 in which said sense elements include Hall cell devices.

7. A serial printer apparatus in accordance with claim 3 in which said sense elements are movable for adjusting the feedback angle of said signals.

8. A serial printer apparatus in accordance with claim 3 in which said plural sense elements have a spacing corresponding with a fraction of the pitch of said stator teeth.

9. A serial printer apparatus in accordance with claim 8 in which said plural sense elements comprise three sense elements spaced one-third tooth pitch apart or multiples thereof.

10. A serial printer apparatus in accordance with claim 2 in which said control means includes means for applying a start signal to said windings to initiate movement of said carrier, means for applying feedback signals from said sense means to said windings to accelerate said carrier, and means responsive to a predetermined number of feedback signals for applying additional feedback signals to said windings for moving said carrier at a constant velocity relative to said print line.

* * * * *